US005681068A

United States Patent [19]

Kleefeldt et al.

[11] Patent Number: 5,681,068

[45] Date of Patent: Oct. 28, 1997

[54] ACTUATING ASSEMBLY FOR MOTOR-VEHICLE DOOR LATCH

[75] Inventors: Frank Kleefeldt, Heiligenhaus; Michael Strathmann; Gerhard Zimmermann, both of Velbert, all of Germany

[73] Assignee: Kiekert AG, Heiligenhaus

[21] Appl. No.: 639,278

[22] Filed: Apr. 25, 1996

[30] Foreign Application Priority Data

May 12, 1995 [DE] Germany ..... 1956955.7
Sep. 23, 1995 [DE] Germany ..... 19535468.0

[51] Int. Cl.[6] ..... E05B 3/00

[52] U.S. Cl. ..... 292/336.3; 292/DIG. 31

[58] Field of Search ..... 292/336.3, 347, 292/216, DIG. 31

[56] References Cited

U.S. PATENT DOCUMENTS

| | | | |
|---|---|---|---|
| 3,606,428 | 9/1971 | Erck et al. | 292/153 X |
| 4,889,373 | 12/1989 | Ward et al. | 292/336.3 |
| 4,929,007 | 5/1990 | Bartczak et al. | 292/336.3 |
| 5,011,202 | 4/1991 | Kato et al. | 292/DIG. 31 X |
| 5,427,421 | 6/1995 | Hamaguchi | 292/216 |

FOREIGN PATENT DOCUMENTS

| | | | |
|---|---|---|---|
| 0 475 037 | 3/1992 | European Pat. Off. . | |
| 2359457 | 2/1978 | France | 292/336.3 |
| 203573 | 8/1989 | Japan | 292/336.3 |
| 1226372 | 3/1971 | United Kingdom | 292/336.3 |

*Primary Examiner*—Rodney M. Lindsey
*Attorney, Agent, or Firm*—Herbert Dubno; Andrew Wilford

[57] ABSTRACT

A motor-vehicle door latch having an element settable in locked, unlocked, and open positions, has an actuating assembly having a pivot defining a pivot axis remote from the latch. An inside locking lever mounted on the pivot has an outer end to one side of the pivot and an inner end to the opposite side of the pivot and a bowden cable is connected between the outer end and the latch element and connects the latch element with the inside lever for joint pivoting between the locked, unlocked, and open positions. An inside actuating lever is mounted on the pivot coaxial with the locking lever. A coupling between the levers is displaceable between a coupling position for displacing the locking lever and bowden cable and thereby setting the element in the open position on pivoting of the actuating lever and a decoupling position for pivoting of the actuating lever without pivoting of the locking lever.

3 Claims, 7 Drawing Sheets

ACTUATING ASSEMBLY FOR MOTOR-VEHICLE DOOR LATCH

FIELD OF THE INVENTION

The present invention relates to a motor-vehicle door latch. More particularly this invention concerns such an actuating assembly for a latch movable between a locked, unlocked, and open positions.

BACKGROUND OF THE INVENTION

A standard motor-vehicle door latch can be moved between an unlatched or open position in which the respective door is not held shut, a latched and unlocked position in which actuation of a handle can unlatch the door, and a latched and locked position in which simple actuation of the handle does not unlatch the door. Such a latch is typically provided for a rear vehicle door.

As described in European patent publication 0,475,037 of H. Kaiser a sleeve of a bowden cable is fixed to the latch housing and the core is connected to an actuating lever in the latch that can be coupled to a retaining pawl that normally holds a lock fork engaged around a bolt extending from an adjacent door post. A remotely controlled actuator is connected through a spring coupling to a locking lever too so that it can set the mechanism in a locked position in which the actuating lever is decoupled from the retaining pawl and cannot open the latch.

Arrangements are known where a single element is used to displace the latch between the locked, unlocked, and open positions. In a classic system the door handle itself is moved in one direction to lock the door, that is make it impossible to open it from outside, and in the opposite direction through a first stroke to unlock it so it can be opened from outside, and through a further stroke to actually open it. All such systems are fairly complex.

OBJECTS OF THE INVENTION

It is therefore an object of the present invention to provide an improved actuating assembly for a motor-vehicle door latch.

Another object is the provision of such an improved actuating assembly for a motor-vehicle door latch which overcomes the above-given disadvantages, that is which is relatively simple.

SUMMARY OF THE INVENTION

A motor-vehicle door latch having an element settable in locked, unlocked and open positions, has an actuating assembly having according to the invention a pivot defining a pivot axis remote from the latch. An inside locking lever mounted on the pivot has an outer end to one side of the pivot and an inner end to the opposite side of the pivot and a bowden cable is connected between the outer end and the latch element and connects the latch element with the inside lever for joint pivoting between the locked, unlocked, and open positions. An inside actuating lever is mounted on the pivot coaxial with the locking lever. A coupling between the levers is displaceable between a coupling position for displacing the locking lever and bowden cable and thereby setting the element in the open position on pivoting of the actuating lever and a decoupling position for pivoting of the actuating lever without pivoting of the locking lever.

In other words the invention proposes a system wherein the lever which is responsible for the setting the latch in three positions is actually formed by two levers. According to the invention the locking lever is L-shaped having an arm with the outer and inner ends and another arm. The coupling includes a link pivoted on one of the levers and having an outer end and a formation on the other lever in which the outer link end is engaged. This formation is a nonstraight cutout in which the outer link end is engaged and the link is rigid.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
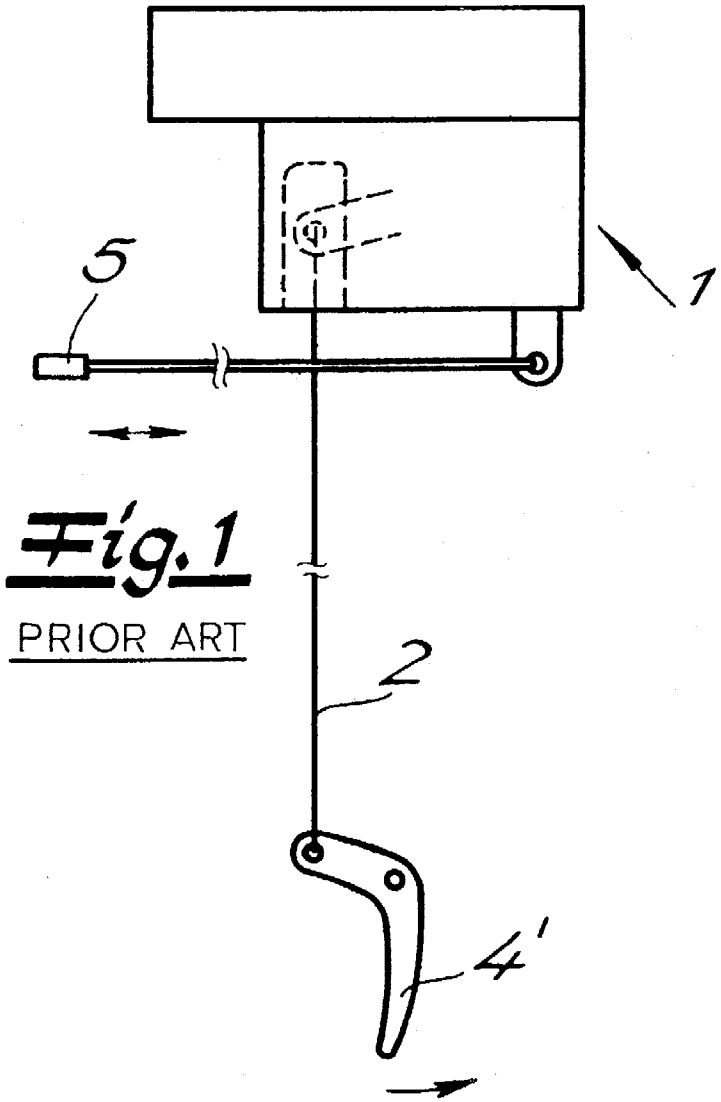
Fig. 1 PRIOR ART

As seen in FIG. 1 a standard prior-art door latch 1 normally for use on a motor-vehicle rear door has a pull button 5 that can be moved up and down or from side to side to move the latch between the locked position, in which it cannot be unlatched, and the unlocked position in which a handle 4' can be operated to unlatch it. A bowden cable 2 connects the handle 4' to the latch 1.

In a more recent system a single L-shaped handle 6 is connected by a single double-acting or push-pull bowden cable 2 to the latch 1 which is constructed so that movement of the handle 6 through a stroke indicated by arrow 7 sets the latch 1 in the locked position. Opposite movement from the pushed-forward locked position as shown by arrow 8 unlocks the latch 1, and further movement in direction 9 from a center position unlatches the latch 1.

Figure 2:
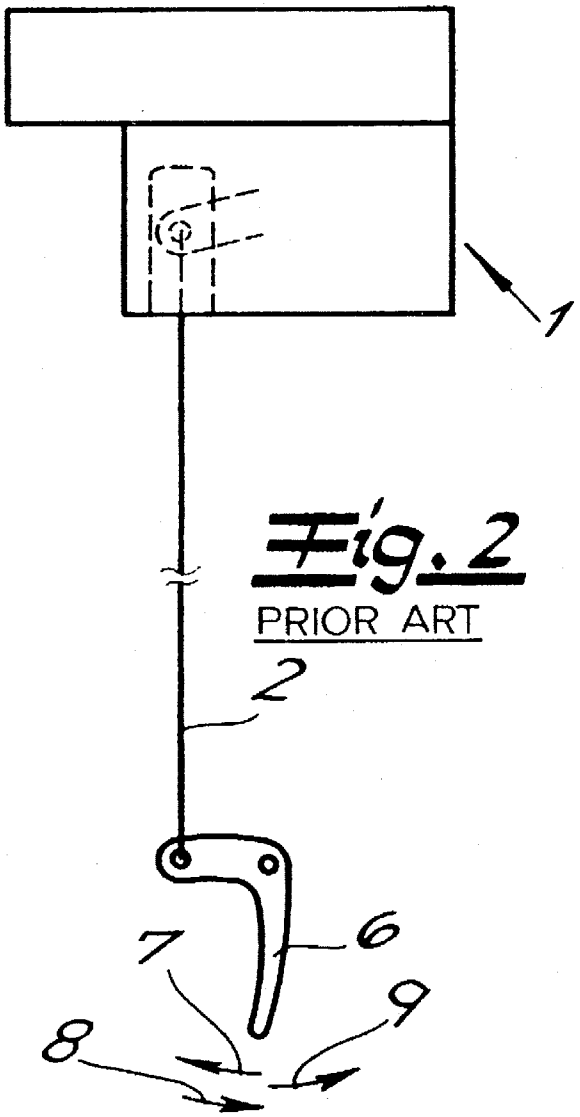
Fig. 2 PRIOR ART
FIGS. 1 and 2 are schematic views of prior-art latch-actuating systems.
Figure 3:
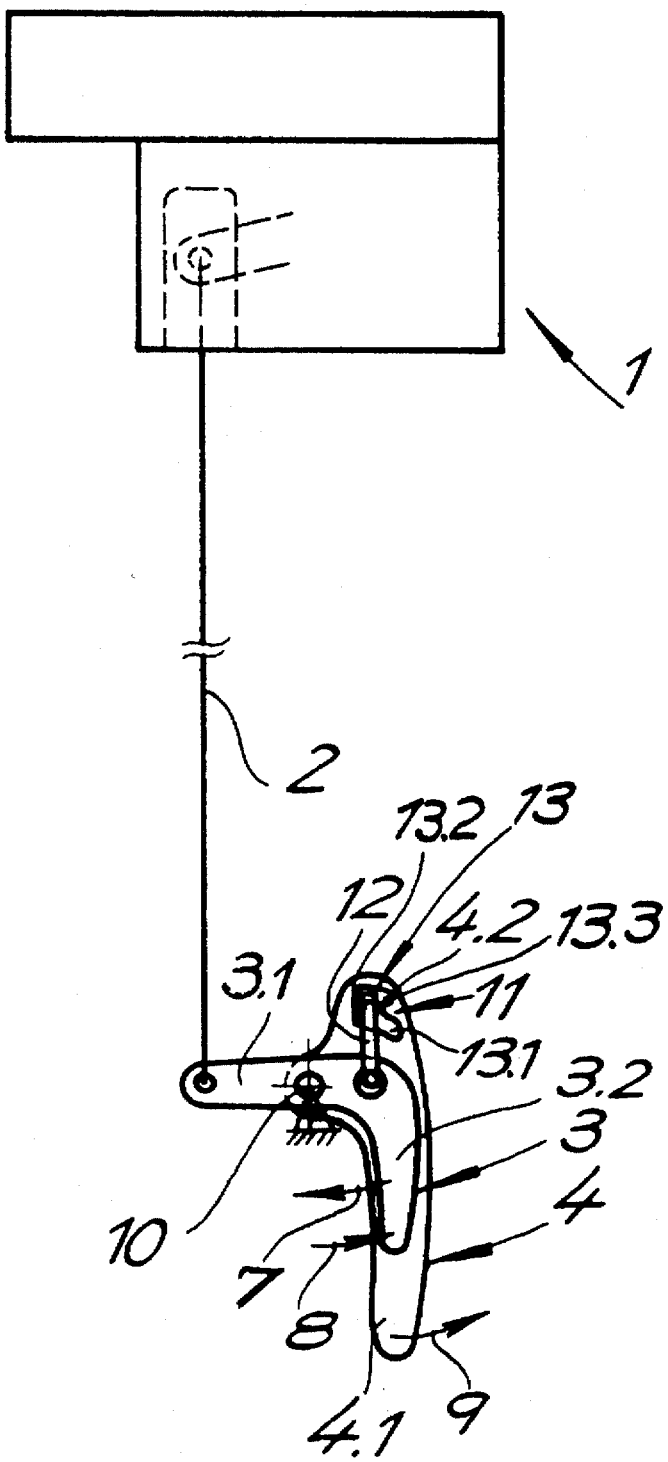
FIG. 3 is a partly schematic view of the latch-actuating system of this invention.
Figure 4:
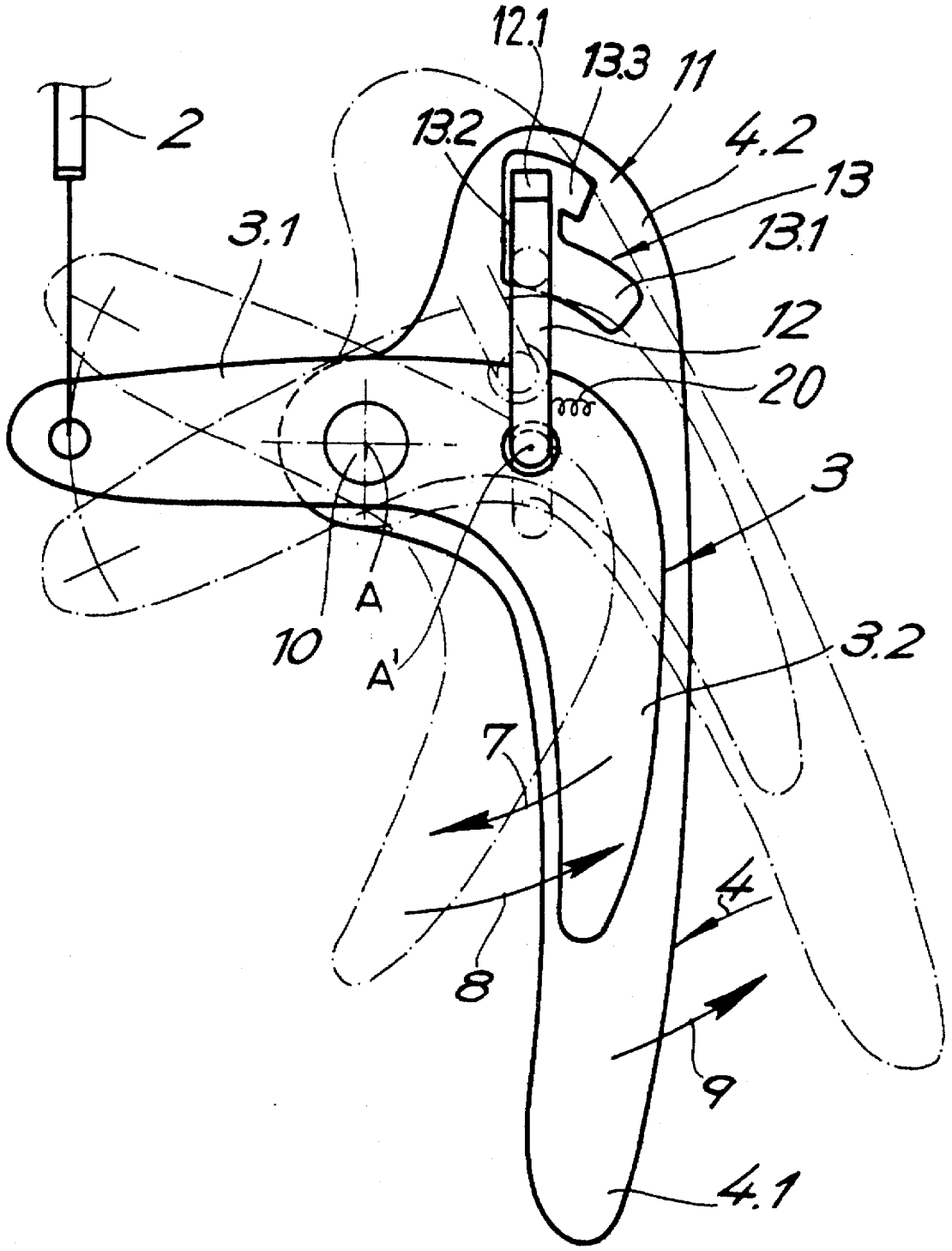
FIG. 4 is a large-scale view of a detail of FIG. 3.

The effect of FIG. 2 is achieved according to the instant invention by the assembly shown in FIGS. 3 and 4. It has an inside locking lever 3 movable through strokes 7 and 8 to lock and unlock the latch 1 and an inside actuating lever 4 movable through stroke 9 to open the latch 1. Both levers 3 and 4 are mounted on a common pivot 10 defining an axis A. The locking lever 3 is L-shaped and has an arm 3.1 whose outer end is connected to the core of the cable 2 and through whose center the pivot 10 fits and an inner end from which another arm 3.2 extends off at a right angle. The actuating lever 4 is formed as a stubby T with the pivot 10 extending through its foot while one arm 4.1 normally extends parallel to and along the arm 3.2 and another arm 4.2 is linked via a coupling 11 to the locking lever 3.

Figure 5:
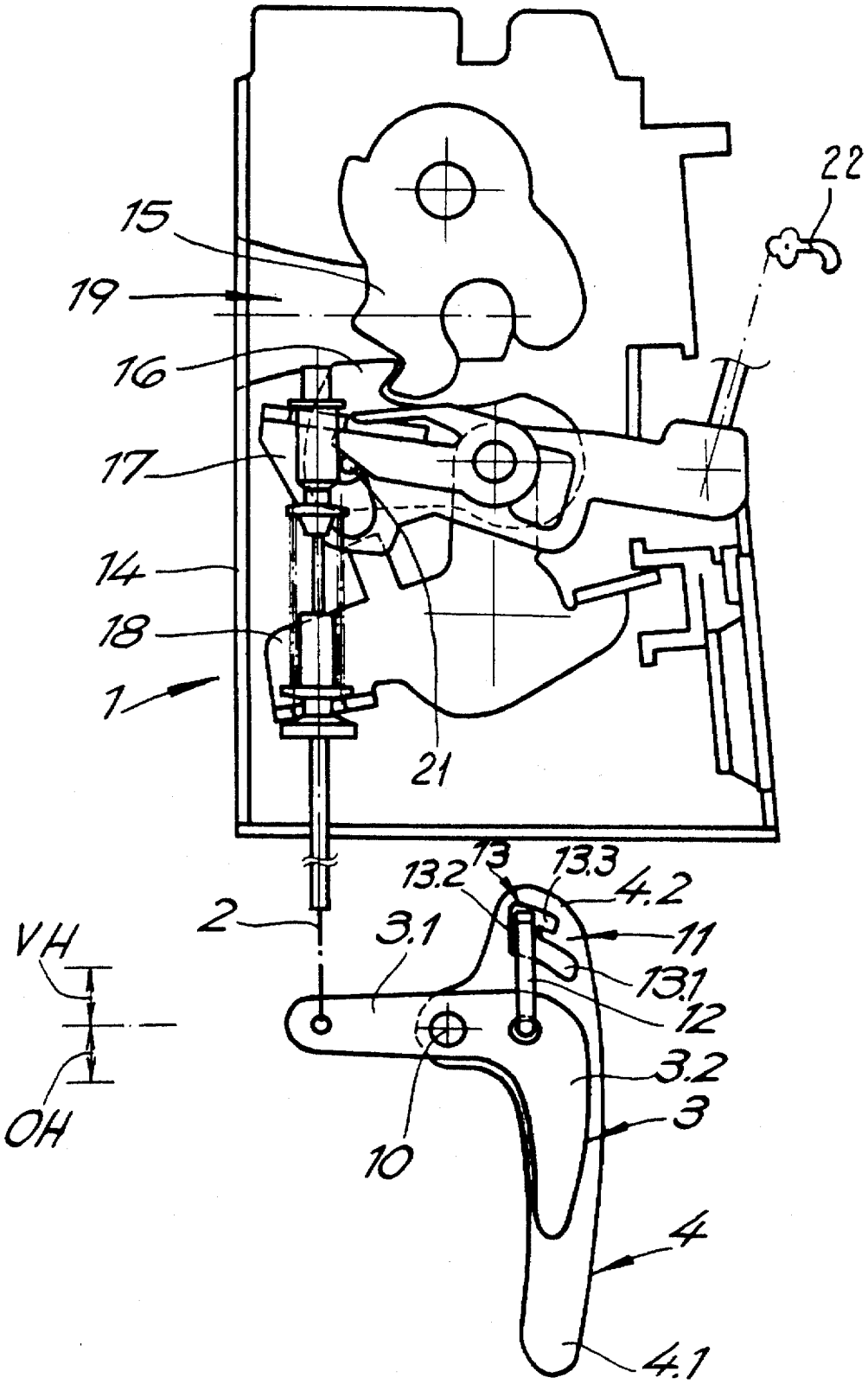
FIG. 5 is a view of the actuating mechanism of this invention and a door latch with the system in the unlocked and unactuated position.
Figure 6:
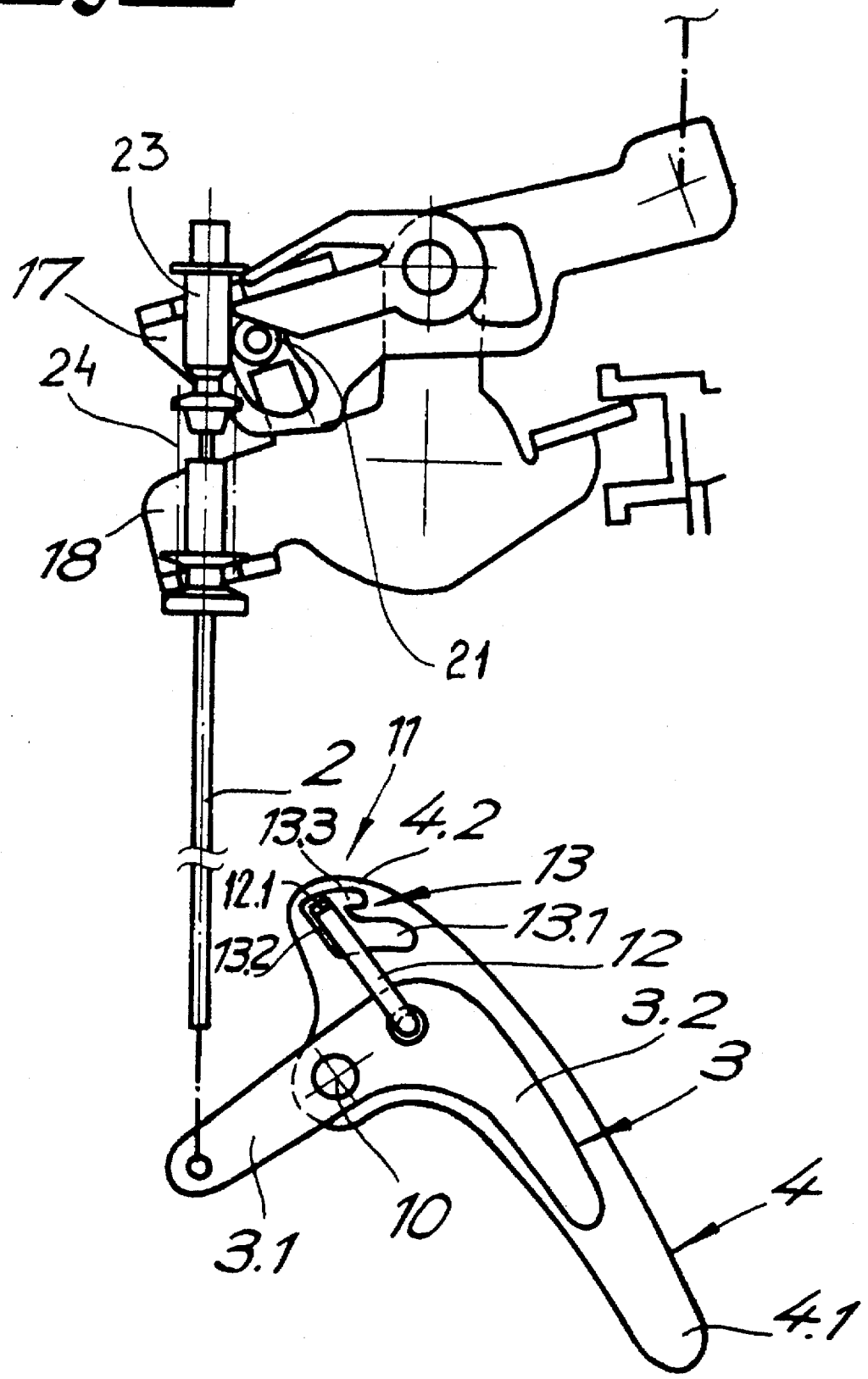
FIGS. 6, 7, and 8 are views of the principal elements of the system of FIG. 5 but respectively in the unlocked and actuated, locked and unactuated, and locked and actuated positions.
Figure 7:
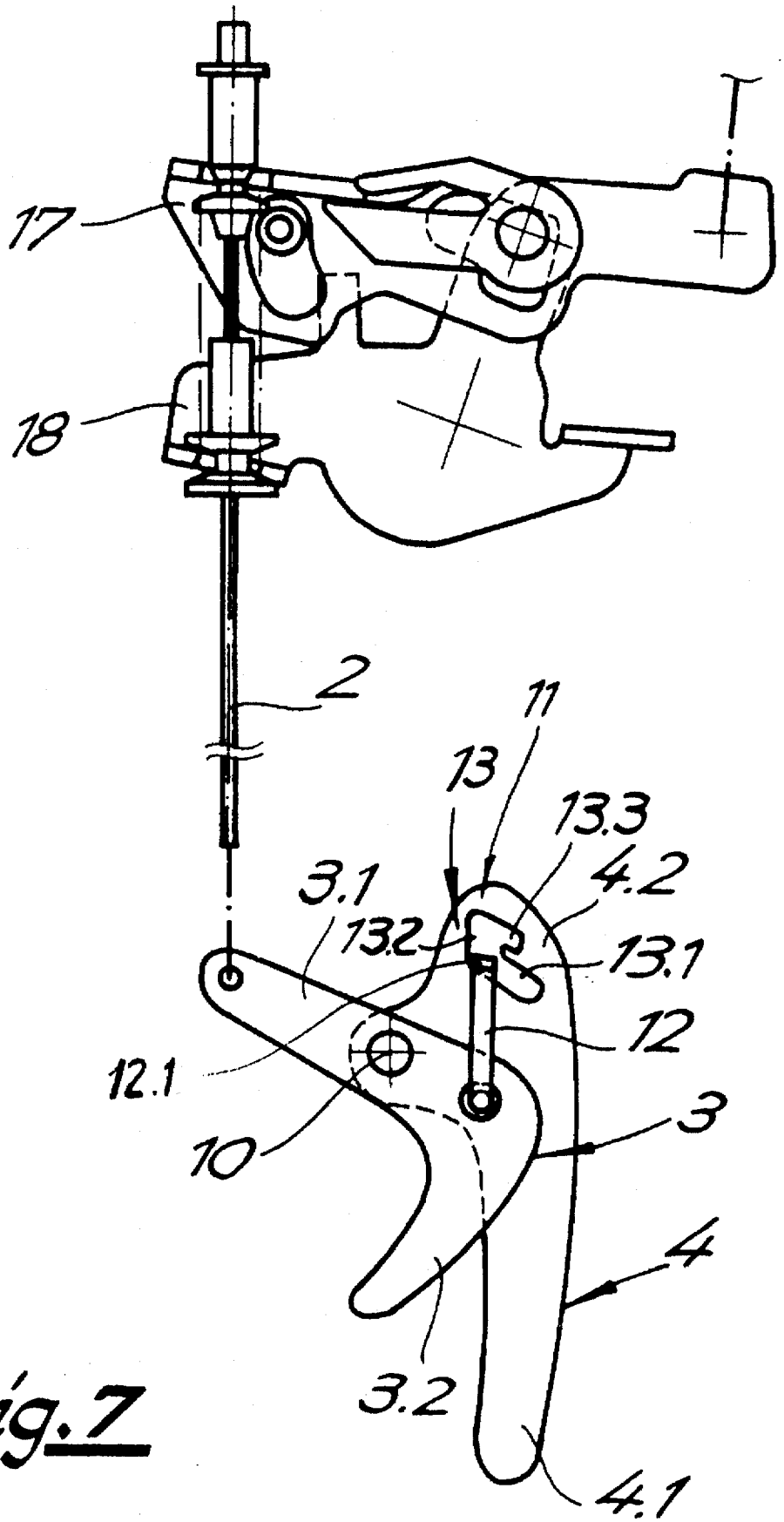
Figure 8:
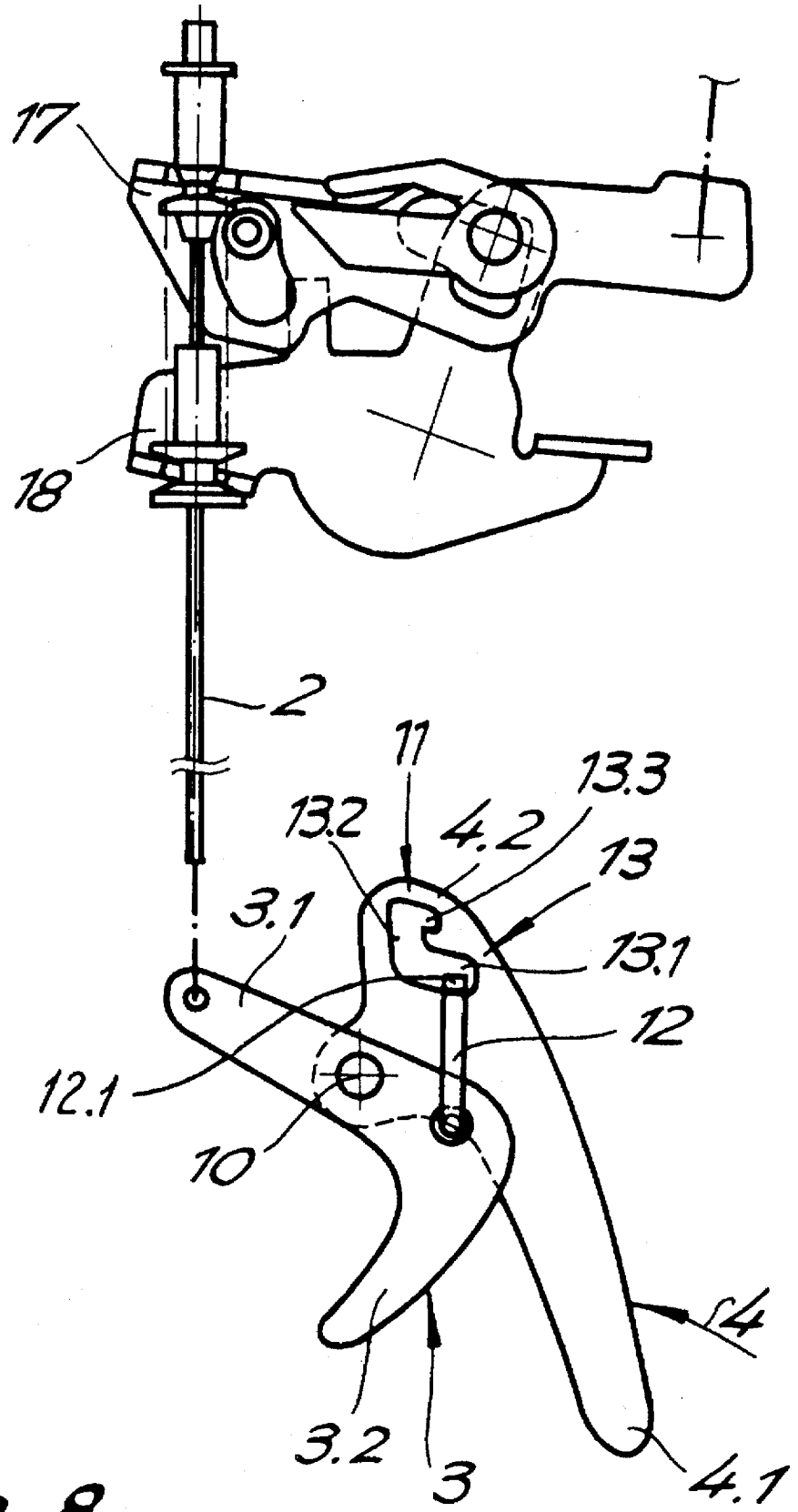

This coupling 11 is movable between a coupling position shown in FIGS. 5 and 6 in which it forces the lever 3 to follow the movements of the lever 4, and the decoupling position of FIGS. 7 and 8 in which it allows the lever 4 to move through its stroke 9 without entraining the lever 3. The coupling 11 is constituted as a pivotal link 12 having one end pivoted at A' in the inner end of the arm 3.1 and a square outer end 12.1 fitting into a C-shaped cutout 13 formed in the arm 4.2. A spring shown schematically at 20 urges the link 12 into the position shown in FIGS. 5 through 8, elastically resisting deflection to either side. In the rest position of the lever 4 the end 12.1 normally rides at the inner or outer end of a bight 13.2 joining upper and lower notches 13.1 and 13.3 of the C-shaped cutout 13. The notches 13.1 and 13.3 extend arcuately with a center of curvature generally at the axis A' while the bight 13.1 extends radially of the axis A'.

The lock 1 as shown in FIG. 5 comprises a housing 14 in which is pivotal a standard fork 15 held in the locked position by a pivotal retaining pawl 16 from whose side extends an actuating pin 21. An actuating lever 17 connected to an outside handle 22 fits over the pin 21 to retract the pawl 15 and allow the fork 15 to pivot and release an unillustrated bolt accepted in a notch 19 of the housing 14. A locking lever 18 is pivotal between an unlocked position (FIGS. 5 and 6) in which it allows the pawl 17 to pivot and a locked position (FIGS. 7 and 8) in which it blocks movement of the pin 21.

The core of the bowden 2 is seated in an element 23 that can slide in the actuating lever 17 and the bowden sleeve is anchored in the lever 18, with a spring 24 interconnecting the two. Thus starting from the unlocked and unactuated position of FIG. 5 it can be seen that the pawl 16 retains the fork 15, the arms 3.2 and 4.1 are aligned with each other, the outer end of the arm 3.1 is aligned with a central position from which it can move in one direction through a stroke OH to open the latch and through an opposite stroke VH for locking it. The end 12.1 of the link 12 lies at the outer end of the cutout 13. Thus as shown in FIG. 6 if the operating lever 4.1 is moved through its stroke 9, the link end 12.1 will catch in the upper notch 13.3 of the cutout formation 13, so that on further pivoting of the lever 4 the lever 3 is entrained to pull down the pawl 17 and open the latch 1.

If, however, the lever 3 has been pivoted through its stroke 7 to lock the latch 1 as shown in FIG. 7, the outer end 12.1 of the link 12 is situated in the inner end of the bight 13.2, level with the longer lower notch 13.1 of the formation 13. When the handle 4 is then actuated to open the latch 1 as indicated in FIG. 8, however, the link end 12.1 will merely travel out in the lower notch 13.1, allowing the lever 4 to pivot about the axis A without pivoting the lever 3. The door provided with the latch 1 remains locked.

We claim:

1. In combination with a motor-vehicle door latch having an element actuatable to set the latch in locked, unlocked, and open positions, an actuating assembly comprising:

a pivot defining a pivot axis remote from the latch;

an L-shaped inside locking lever mounted on the pivot and having two arms one of which has an outer end to one side of the pivot and an inner end to the opposite side of the pivot;

a bowden cable connected between the outer end and the latch element and connecting the latch element with the inside lever for joint pivoting between the locked, unlocked, and open positions;

an inside actuating lever mounted on the pivot coaxial with the locking lever; and means including a coupling between the levers displaceable between a coupling position for permitting displacement of the locking lever and bowden cable and setting of the element in the open position on pivoting of the actuating lever and a decoupling position for permitting pivoting of the actuating lever without pivoting of the locking lever, the coupling including a link pivoted on one of the levers and having an outer end and a formation on the other of the levers in which the outer link end is engaged.

2. The actuating assembly for a motor-vehicle door latch defined in claim 1 wherein the formation is a nonstraight cutout in which the outer link end is engaged.

3. The actuating assembly for a motor-vehicle door latch defined in claim 2 wherein the link is rigid.

* * * * *